United States Patent [19]

Copeland et al.

[11] 3,958,363

[45] May 25, 1976

[54] DOLL AND WHEELED VEHICLE

[75] Inventors: Leigh D. Copeland, Chicago; Howard J. Morrison, Deerfield, both of Ill.

[73] Assignee: Marvin Glass & Associates, Chicago, Ill.

[22] Filed: Jan. 27, 1975

[21] Appl. No.: 544,285

[52] U.S. Cl. ..... 46/106; 46/107; 46/116

[51] Int. Cl.[2] ..... A63H 11/10

[58] Field of Search ..... 46/116, 97, , 99, 101, 46/106, 107, 147

[56] References Cited

UNITED STATES PATENTS

| | | | |
|---|---|---|---|
| 315,380 | 4/1885 | Bailey | 46/107 |
| 2,137,950 | 11/1938 | Ranney | 46/107 |
| 2,480,996 | 9/1949 | Bocchino | 46/99 |
| 2,647,757 | 8/1953 | Kreeger | 46/107 |
| 2,726,481 | 12/1955 | Sebel | 46/107 |

FOREIGN PATENTS OR APPLICATIONS

| | | | |
|---|---|---|---|
| 612,922 | 11/1960 | Italy | 46/107 |

*Primary Examiner*—Louis G. Mancene
*Assistant Examiner*—Robert F. Cutting
*Attorney, Agent, or Firm*—Coffee & Sweeney

[57] ABSTRACT

A doll and wheeled vehicle wherein the doll comprises a separate playable toy positionable within the stroller and readily removable therefrom for individual play. The stroller has at least a pair of wheels connected by an axle having a pair of 180° out-of-phase U-shaped crank portions. A flexible strap is connected to the bight portions of the U-shaped cranks and can be wrapped about the doll when positioned in the stroller to effect a side-to-side and twisting motion of the doll relative to the stroller as the wheels and axle rotate when pushing the stroller over a suitable surface.

19 Claims, 5 Drawing Figures

DOLL AND WHEELED VEHICLE

BACKGROUND AND SUMMARY OF THE INVENTION

This invention relates to a wheeled vehicle, such as a stroller, for use with a figure toy, such as a doll, so as to give animated movement to the doll as the stroller is pushed over a floor or the like.

The use of figures on wheeled vehicles so as to effect movement of the figures in response to movement of the vehicle is well known in the art. In most instances, the figures are permanent, usually fabricated of rigid components, parts of the entire unit fixedly mounted to the vehicle and connected by linkages or gears to either the wheels or the axles of the vehicle. Such combined structures are provided mostly for amusement purposes rather than presenting life-like animation to the figure.

In contrast to the above amusement devices, attempts have been made to utilize a separate playable doll with a doll carriage to effect movement of the doll as the carriage is moved over a supporting surface. Such is shown in U.S. Pat. Nos. 315,380 and 2,480,996. However, in both of these patents, the separate doll is positioned on a supporting seat or bed and lays thereon in an idle condition simply for movement therewith. More particularly, in U.S. Pat. No. 315,380 the doll is strapped into the seat of a swing and simply moves with the swing in an idle condition. In U.S. Pat. No. 2,480,996 the doll simply is placed in an upwardly facing prone position on top of a bed portion and is moved up and down with the bed portion as the carriage is moved over a supporting surface.

The present invention is directed to providing a new and improved doll and wheeled vehicle where a separate playable doll is positioned on a support of the vehicle and is caused to move in a life-like fashion relative to that support as the vehicle is moved over a supporting surface.

In the exemplary embodiment of the invention, the wheeled vehicle takes the form of a stroller having a forwardly facing L-shaped seat upon which the separately playable doll is positioned in a seated disposition. The stroller has handle means for pushing, and two pairs of wheels connected by a pair of axles. The rear axle has a pair of axially spaced U-shaped portions which protrude outwardly from the axle 180° out-of-phase. A flexible strap is connected to the bight portions of the U-shaped crank portions of the axle and is wrapped about the waist of the doll so as to transmit motion from the U-shaped cranks, as the axle rotates, to side-to-side and twisting movement of the doll in a life-like manner relative to the L-shaped seat on which the doll is positioned. The strap has a pair of free ends opposite the U-shaped cranks to facilitate positioning the strap about the doll, with complementary connecting means on the ends of the strap. A friction pad is provided on the inside of one of said ends for engagement with the doll to facilitate effecting said side-to-side and twisting movement.

Other objects, features and advantages of the invention will be apparent from the following detailed description taken in connection with the accompanying drawings.

DETAILED DESCRIPTION OF THE INVENTION

Figure 1:
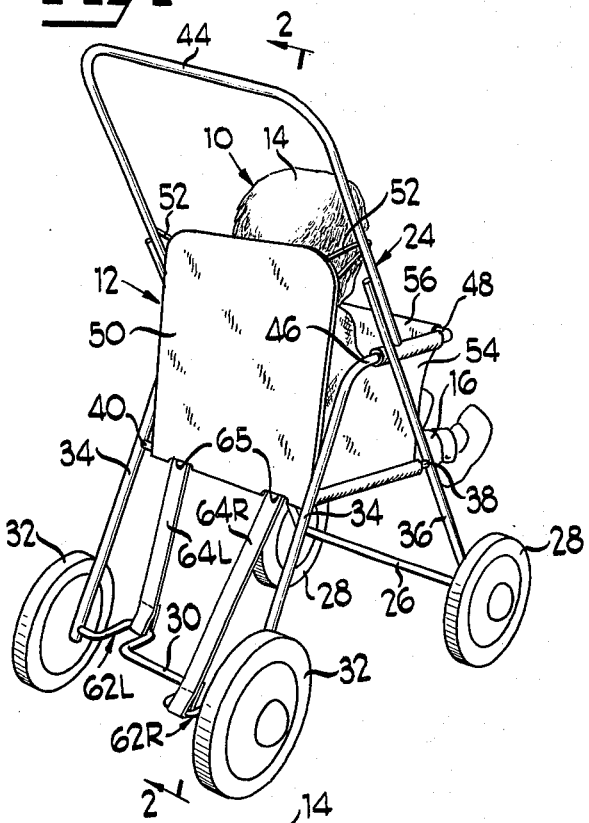
FIG. 1 is a rear perspective view of the doll and stroller of the present invention.
Figure 2:
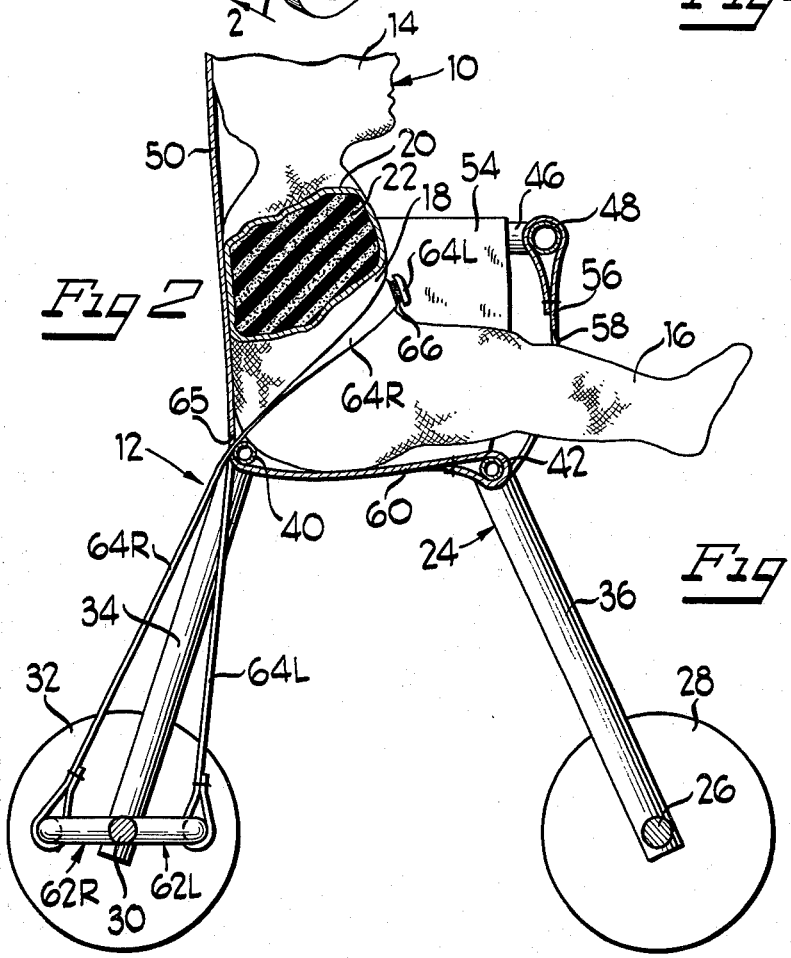
FIG. 2 is a vertical section, on an enlarged scale, taken generally along the line 2—2 of FIG. 1, generally through the right shoulder of the doll and the proximate portions of the stroller.

Referring to the drawings in greater detail, FIGS. 1 and 2 show a separately playable doll, generally designated 10, positionable in an upright seated disposition within a wheeled vehicle in the form of a stroller, generally designated 12.

The doll 10 conventionally includes a head 14, a pair of legs 16, a pair of arms (not shown) and a torso portion 18 (FIG. 2). The doll preferably is a soft doll having an outer covering 20 and interior stuffing 22, as seen in FIG. 2. Of course, other appropriate constructions of the doll is contemplated by the present invention.

The stroller 12 includes a frame, generally designated 24, a front axle 26 connected to a pair of front wheels 28, and a rear axle 30 fixedly connected to a pair of rear wheels 32 for rotation therewith.

The frame 24 includes a pair of rear upwardly inclined rods 34 on which the rear axle 30 is journalled at the lower ends thereof, and a pair of front upwardly inclined rods 36 to which the front axle 26 is journalled at the lower ends thereof. The front and rear rods 36 and 34, respectively, are connected by front to rear cross braces 38. The rear rods 34 are connected by a lateral cross brace 40 (FIG. 2) and the front rods 36 are connected by a lateral cross brace 42. A U-shaped handle 44 (FIG. 1) is connected to the upper ends of the rods 36. The rear rods 34 are integrally connected at their upper ends by a forwardly facing U-shaped portion which supports a fabric seat, described hereinafter. The U-shaped portion includes a pair of forwardly extending parallel rod portions 46 and a front cross rod portion 48. The seat for the doll includes a stiff back 50 connected at its lower end to the cross rod 40 and at its upper end by connecting means 52 to the depending legs of the handle 44. The seat has fabric side panels 54 which are wrapped at their lower ends about the cross braces 38 and at their upper ends about the forwardly protruding rod portions 46. The seat has a front panel 56 which is wrapped about the cross rod portion 48 at its upper end and the cross brace 42 at its lower end. Apertures 58 (FIG. 2) are formed in the front panel 56 to accommodate the doll's legs 16. A seat panel 60 (FIG. 2) on which the doll is positioned, spans the front cross brace 42 and the rear cross brace 40.

Crank means is provided on the rear axle for effecting movement of the doll 10 through a strap, in response to rotation of the rear wheels 32 and rear axle 30. More particularly, a pair of U-shaped cranks 62L and 62R are formed in the rear axle 30 axially spaced from each other and extending radially outwardly from the axle 180° out-of-phase. A strap having a righthand portion 64R and a lefthand portion 64L is wrapped about the bight portions of the respective left and righthand U-shaped cranks as shown in the drawings. The strap portions extend upwardly from the cranks through apertures 65 in the rear panel 50 of the seat and is wrapped about the doll 10, as shown in FIG. 2, and schematically in FIGS. 4 and 5, when the doll is properly positioned in the seat of the stroller. As can be seen in FIG. 2, the strap portions are wrapped about the waist portion of the doll.

Figure 3:
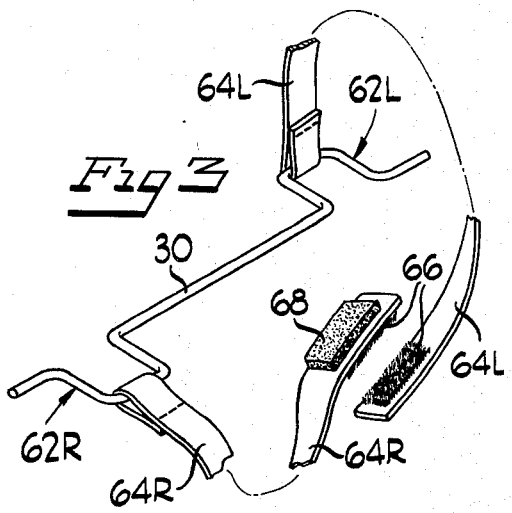
FIG. 3 is a perspective view of the rear axle and crank means, with a fragmentary presentation of the strap.

As seen in FIG. 3, the free ends of the strap portions 64L, 64R opposite the cranks 62L, 62R have complementary connecting means in the form of bristled pads 66 for securely engaging the strap with the doll. Of course, other appropriate connecting means, such as snap fasteners can be used. Should it be desirable to employ a plurality of different size dolls with the stroller of the present invention, the pads 66 could be lengthened and/or plural snap fasteners could be used to adjust the length of the strap. In addition, a friction pad 68 is provided on one of the strap portions, strap portion 64 or in FIG. 3, to facilitate effecting movement to the doll.

Figure 4:
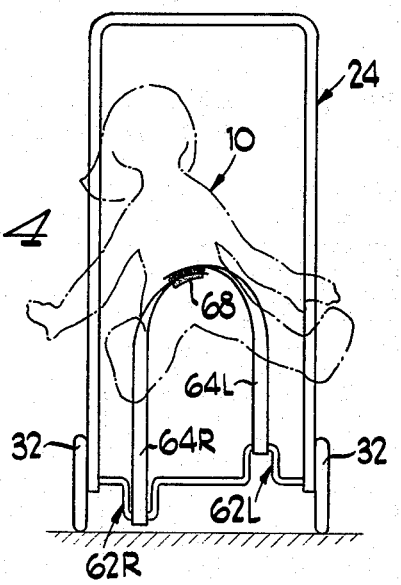
FIG. 4 is a somewhat schematic rear elevational view showing the crank means and strap in one position effecting sideward movement of the doll to the left.
Figure 5:
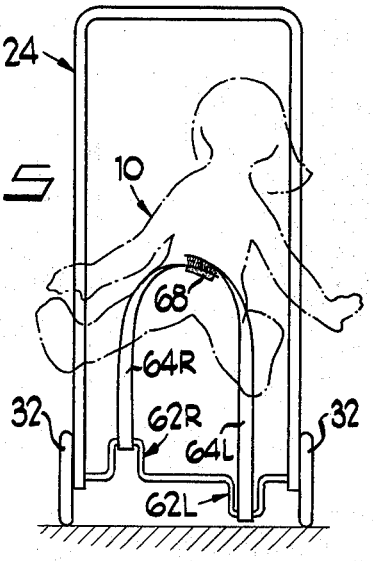
FIG. 5 is a view similar to that of FIG. 4 with the rear axle and crank rotated 180° effecting sideward movement of the doll to the right.

Referring to FIGS. 4 and 5, the side-to-side twisting movement of the doll 10 is schematically shown in the extreme positions, with the cranks 62L and 62R rotated 180° in the two different views. In this manner, a very life-like movement is imparted to the doll in a side-to-side and twisting motion relative to the very support on which the doll is placed. By utilizing the strap, the connecting means which transmits the motion from the cranks on the rear axle is hardly noticeable and gives a very real effect particularly with children.

The foregoing detailed description has been given for clearness of understanding only and no unnecessary limitations should be understood therefrom as some modifications will be obvious to those skilled in the art.

We claim:

1. For use with a separate figure toy or the like, a wheeled vehicle, comprising:

a frame including support means for receiving and freely supporting a figure toy;

ground engaging wheel means for rollingly supporting the frame for movement over a suitable surface;

axle means journalled on said frame and fixedly connected to said wheel means for rotation therewith, said axle means including plural axially spaced out-of-phase crank means; and connecting means secured to each of said crank means and engageable with the figure toy when positioned on said support means to transmit motion from said axially spaced crank means to side-to-side movement of the figure toy in a life-like manner relative to the support means on the frame, in response to rotation of said axle means.

2. The wheeled vehicle of claim 1 wherein said crank means comprises a pair of axially spaced U-shaped portions of the axle means with the bight portions of the U-shape thereby being concentrically offset relative to the major axis of the axle means, said U-shaped portions being out-of-phase by protruding outwardly from the axle means at different angles relative thereto.

3. The wheeled vehicle of claim 2 wherein said connecting means comprises a flexible strap connected to the bight portions of said U-shaped axle portions and extending around and in engagement with the figure toy when positioned on said support means to effect said side-to-side movement of the figure toy.

4. The wheeled vehicle of claim 3 wherein said strap comprises two pieces having free ends opposite said crank means to facilitate positioning about the figure toy, the free ends having complementary engaging portions and the strap having a friction pad for engagement with the figure toy.

5. The wheeled vehicle of claim 3 wherein the vehicle is in the form of a baby stroller having a forwardly facing L-shaped seat for supporting the figure toy in an upright seated position, said strap being positionable about the waist of the figure toy for transmitting said side-to-side movement thereto along with a twisting motion to the figure toy about a generally upright axis.

6. The figure toy of claim 2 wherein said U-shaped crank portions protrude outwardly from the major axis of the axle means approximately 180° out-of-phase.

7. The wheeled vehicle of claim 6 wherein said connecting means comprises a flexible strap connected to the bight portions of said U-shaped axle portions and extending around and in engagement with the figure toy when positioned on said support means to effect said side-to-side movement of the figure toy.

8. A wheeled vehicle and doll combination, comprising:

a doll having a head, limbs and a torso portion;

a frame including support means for receiving and freely supporting the doll;

ground engaging wheel means for rollingly supporting the frame for movement over a suitable surface;

axle means journalled on said frame and fixedly connected to said wheel means for rotation therewith, said axle means including plural axially spaced out-of-phase crank means; and connecting means secured to each of said crank means and engageable with the doll when positioned on said support means to transmit motion from said axially spaced crank means to side-to-side movement of the doll in a life-like manner relative to the support means on the frame, in response to rotation of said axle means.

9. The combination of claim 8 wherein said crank means comprises a pair of axially spaced U-shaped portions of the axle means with the bight portions of the U-shapes thereby being concentrically offset relative to the major axis of the axle means, said U-shaped portions being out-of-phase by protruding outwardly from the axle means at different angles relative thereto.

10. The combination of claim 9 wherein said connecting means comprises a flexible strap connected to the bight portions of said U-shaped axle portions and extending around and in engagement with the doll when positioned on said support means to effect said side-to-side movement of the doll.

11. The combination of claim 10 wherein said strap comprises two pieces having free ends opposite said crank means to facilitate positioning about the doll, the free ends having complementary engaging portions and the strap having a friction pad for engagement with the doll.

12. The combination of claim 10 wherein the vehicle is in the form of a baby stroller having a forwardly facing L-shaped seat for supporting the doll in an upright seated position, said strap being positionable about the waist of the doll for transmitting said side-to-side movement thereto along with a twisting motion to the doll about a generally upright axis.

13. The combination of claim 9 wherein said U-shaped crank portions protrude outwardly from the major axis of the axle means approximately 180° out-of-phase.

14. The combination of claim 13 wherein said connecting means comprises a flexible strap connected to the bight portions of said U-shaped axle portions and extending around and in engagement with the doll when positioned on said support means to effect said side-to-side movement of the doll.

15. A wheeled vehicle and figure toy combination, comprising:

a frame;

a figure toy on said frame;

a pair of wheels for rollingly supporting the frame for movement over a suitable surface;

an axle journalled on said frame and fixedly connected to the wheels for rotation therewith;

crank means on said axle comprising a pair of axially spaced U-shaped portions of the axle which present bight portions of the U-shapes spaced concentrically from the axle, said U-shaped portions protruding outwardly from the axle at different angles; and connecting means between the bight portions of said U-shaped portions and said figure toy for transmitting motion to the figure toy relative to the frame in response to rotation of the axle.

16. The combination of claim 15 wherein said U-shaped portions protrude outwardly from said axle 180° apart.

17. For use with a separate figure toy or the like, a wheeled vehicle, comprising:

a frame including support means for freely receiving and supporting the separate figure toy;

ground engaging wheel means for rollingly supporting the frame for movement over a suitable surface;

axle means journalled on said frame and fixedly connected to said wheel means for rotation therewith and including crank means on said axle means; and a flexible strap secured to said crank means and positionable about the figure toy when positioned on said support means to transmit motion from said crank means to movement of the figure toy relative to the support means on the frame, in response to rotation of said axle means.

18. The wheeled vehicle of claim 17 wherein said strap comprises two pieces having free ends opposite said crank means to facilitate positioning about the figure toy, the free ends having complementary engaging portions and the strap having a friction pad for engagement with the figure toy.

19. The wheeled vehicle of claim 18 wherein the vehicle is in the form of a baby stroller having a forwardly facing L-shaped seat for supporting the figure toy in an upright seated position, said strap being positionable about the waist of the figure toy for transmitting said side-to-side movement thereto along with a twisting motion to the figure toy about a generally upright axis.

* * * * *